US005591021A

United States Patent [19]

Guentert et al.

[11] Patent Number: 5,591,021

[45] Date of Patent: Jan. 7, 1997

[54] FUEL-INJECTION PUMP FOR INTERNAL COMBUSTION ENGINES

[75] Inventors: Josef Guentert, Gerlingen; Karsten Hummel, Beilstein; Guido Kampa, Althengstett; Axel Paetz, Filderstadt, all of Germany; Karel Kolar, Czech, Czechoslovakia

[73] Assignee: Robert Bosch GmbH, Stuttgart, Germany

[21] Appl. No.: 561,653

[22] Filed: Nov. 22, 1995

[30] Foreign Application Priority Data

Nov. 22, 1994 [DE] Germany ..... 44 41 506.0

[51] Int. Cl.[6] ..... F02M 43/00; F02M 45/06

[52] U.S. Cl. ..... 417/494; 417/499; 123/500; 123/503

[58] Field of Search ..... 417/494, 499; 123/500, 503

[56] References Cited

U.S. PATENT DOCUMENTS

| | | | |
|---|---|---|---|
| 2,696,786 | 12/1954 | Fleck et al. | 417/499 |
| 2,810,375 | 10/1957 | Froehlich et al. | 417/494 X |
| 3,438,327 | 4/1969 | Thompson | 417/494 X |
| 4,013,055 | 3/1977 | Sommer | 417/499 X |
| 4,881,506 | 11/1989 | Hoecker | 417/494 X |
| 4,964,789 | 10/1990 | Schueler et al. | 417/494 |
| 5,396,871 | 3/1995 | Faupel et al. | 417/494 X |

FOREIGN PATENT DOCUMENTS

| | | | |
|---|---|---|---|
| 494649 | 10/1938 | United Kingdom | 123/503 |

*Primary Examiner*—Richard E. Gluck

*Attorney, Agent, or Firm*—Edwin E. Greigg; Ronald E. Greigg

[57] ABSTRACT

A fuel-injection pump for internal combustion engines, particularly an in-line injection pump for diesel engine, with a control bore in the pump cylinder and with an upper control edge for determining the start of feed and an oblique spill edge for determining the end of feed. The pump piston is rotated about its longitudinal axis in order to set the desired feed quantity, for the purpose of achieving a better regulating behavior of the system as a whole, comprising the fuel-injection pump, feed-quantity regulator and internal-combustion engine. The spill edge is subdivided, along its run over a part of the circumference of the pump piston, into portions with different angles of inclination ($\alpha_1$, $\alpha_2$) to the axis of the pump piston. The control-edge portion having the large angle of inclination ($\alpha_2$) is located in the region of the pump piston which passes over the control bore during the pump-piston stroke in a rotary position of the pump piston for small feed quantities (lowered load range of the internal-combustion).

8 Claims, 3 Drawing Sheets

FUEL-INJECTION PUMP FOR INTERNAL COMBUSTION ENGINES

STATE OF THE ART

The invention proceeds from a fuel-injection pump for internal-combustion engines, in particular from an in-line injection pump for diesel engines.

In a known fuel-injection pump of this type (Bosch "Technische Unterrichtung, Diesel-Einspritzpumpen Typ PE und PF" ["Technical Information, Diesel Injection Pumps Type PE and PF"]; EP 0,282,819 B1), the spill edge, which is formed on the upper groove edge of the oblique control groove extending in the pump-piston casing, that is to say the groove edge located nearer to the pump working space, has a constant pitch over its run in the pump-piston casing, that is to say it runs at a constant acute angle of inclination to the pump-piston axis. This constant pitch extends into the upper control-edge portion which is located nearest to the pump working space and which, in order to set small feed quantities under a low load (or low rotational speed) of the internal-combustion engine, is set by the feed-quantity regulating device as a result of the rotation of the pump piston. The result of this is that, in this control-edge portion, the change in the feed quantity in the event of small regulating travels is in percentage terms very large in relation to the injected feed quantity. These small regulating travels,together with the large changes in the feed quantity, result in irregular injection quantities in the internal combustion engine through the injection nozzle connected to the injection conduit, thus leading to an irregular running of the internal-combustion engine which, in turn, leads via the feed-quantity regulating device to instabilities in the system as a whole (the build-up effect).

In conventional in-line pumps, this disadvantage is more or less fully compensated by the use of appropriate regulator designs of the feed-quantity regulating device.

ADVANTAGES OF THE INVENTION

In contrast to this, the advantage of the fuel-injection pump according to the invention, is that a better regulating behaviour of the system in the lower load range, where only small feed quantities are required, is achieved by means of measures relating to the pump element. Consequently, the regulating behaviour of the system does not have to be ensured solely by the selection and adaptation of suitable feed-quantity regulating devices, with the result that the user gains greater freedom in the choice of the regulators which can be operated on the fuel-injection pump. The fuel-injection pump can therefore also be employed in systems which are demanding in terms of the regulating behaviour of the system, and thus opens up new market segments. This substantially improved regulating behaviour of the fuel-injection pump is achieved by means of the "flatter" spill edge in the lower load range of the internal-combustion engine, which makes it possible to open a smaller flow-off cross-section over the same regulating-travel intervals, so that the feed quantity can be set substantially more effectively via a variation in the regulating travel (rotary travel of the pump piston). This can be seen clearly in the diagram of FIG. 4, in which the feed quantity FM (at a constant stroke of the pump piston) is shown plotted against the regulating travel RW (rotary travel of the pump piston). The curve a represented by an unbroken line shows the feed-quantity line when the spill edge is designed with a constant angle of inclination. The curve b represented by a broken line shows the feed-quantity characteristic in the case of the flattening according to the invention of the spill edge in the lower load range of the internal-combustion engine. It can be seen clearly that, with the same regulating travels, smaller feed quantities can be set or, conversely, the same feed quantity can be obtained only after a longer regulating travel has been set. The change in feed quantity can thus be adapted very much more sensitively and more exactly to the instantaneous requirement of the internal-combustion engine in the lower load range.

Since the manufacture of a pump piston having different pitches of the spill edge may be difficult to master, in order to simplify production it is proposed, in a first work step, to make the oblique control groove with a constant angle of inclination or constant pitch in the casing surface in a known way and, in a second work step, to grind around the upper groove flank to form the spill edge by means of a grinding head introduced into the groove, the grinding head having a shape corresponding to the "kinked" run of the spill edge.

The fuel-injection pump according to the invention can be equipped with or without a delivery valve between the pump working space and injection delivery conduit, a backflow throttle valve preferably being used as the delivery valve.

Advantageous developments and improvements of the fuel-injection pump are possible as a result of the measures set forth hereinafter.

According to an advantageous embodiment of the invention, the upper control edge is additionally formed on the lower groove flank of a groove which is open towards the end face of the pump piston and runs over a part of the circumference of the pump piston and which, in the region of the pump piston passing over the control bore during the pump-piston stroke in a rotary position assumed by the pump piston in the case of small feed quantities, runs obliquely towards the end-face edge of the pump piston. As a result of this constructive measure at the upper control edge, the feed quantity can be further reduced between the upper control edge of the start of feed and the spill edge for the end of the feed, so that, in the lower load range of the internal-combustion engine, a relatively small change in the feed quantity in dependence on the regulating travel, that is to say on the rotary angle of the pump piston, is achieved, thus once again markedly increasing the sensitivity of the regulating in the lower load range. There is consequently, at the same time, an advance of the start of feed in the lower load range in comparison with the start of feed under medium load or full load, and this is often desirable.

BRIEF DESCRIPTION OF THE DRAWINGS

The invention is explained in more detail in the following description by means of an exemplary embodiment illustrated in the drawing. In this.

DETAILED DESCRIPTION OF THE EXEMPLARY EMBODIMENT

Figures 1, 2:
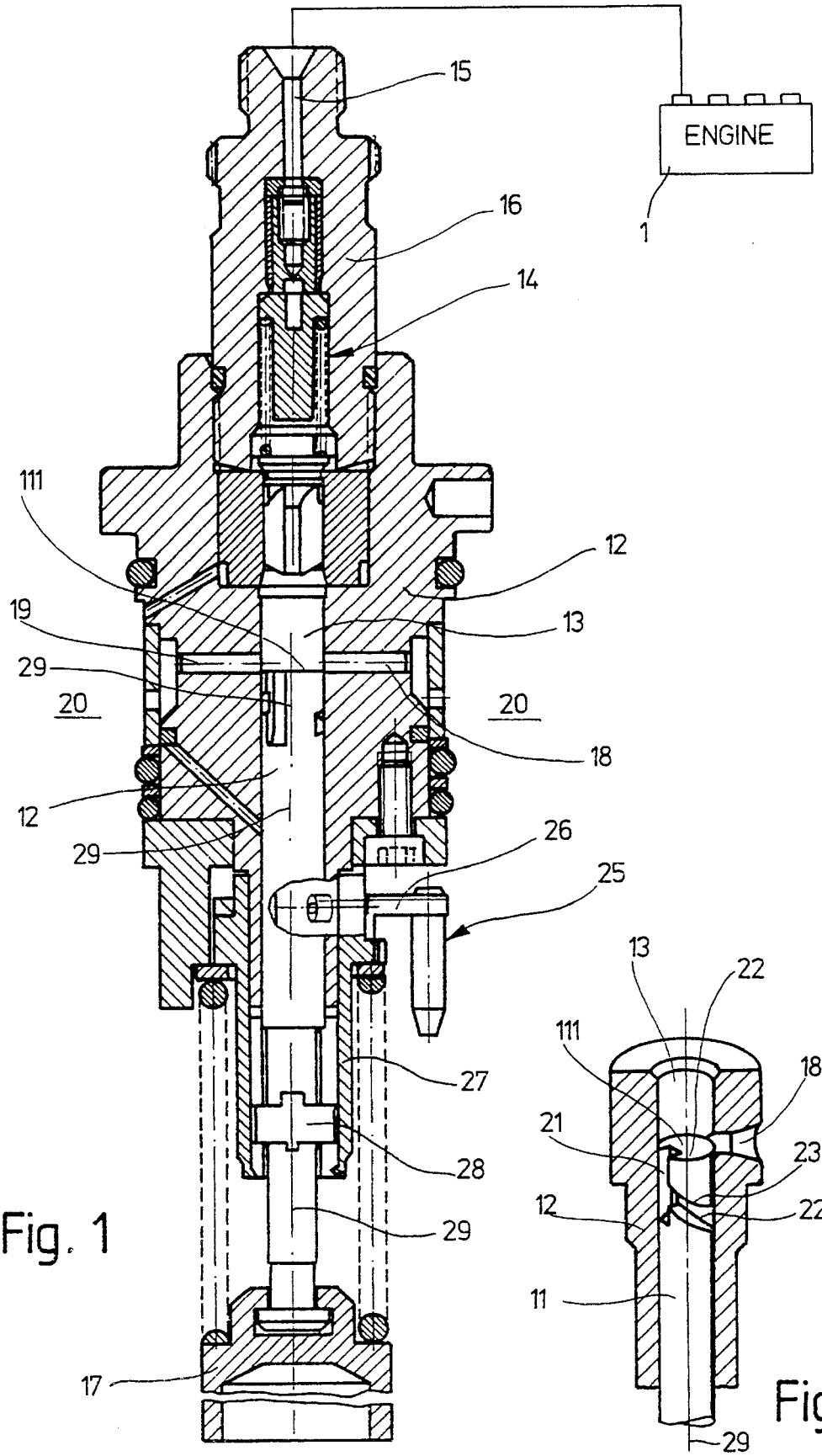
FIG. 1 shows in cut-out form a longitudinal section through a fuel-injection pump having a two-hole pump element.
FIG. 2 shows in cut-out form, partially in section, a perspective representation of a single-hole pump element in a fuel-injection valve

The fuel-injection pump to be seen in cut-out form in longitudinal section in FIG. 1 and intended for an internal-combustion engine 1 has a pump piston 11 and a pump cylinder 12 which together form the so-called pump element. The pump piston 11, by means of an end face 111, delimits in the pump cylinder 12 a pump working space 13 which is connected via a delivery valve 14 to an injection delivery conduit 15. The delivery valve 14 is inserted in a valve holder 16 which is screwed on the end face into the pump cylinder 12. The pump piston 11 guided in a central bore of the pump cylinder 12 is fitted so exactly to the pump cylinder 12 that it seals off the pump working space 13 even at very high pressures and low rotational speeds. It is driven in a to-and-fro axial stroke movement via a roller tappet 17.

Depending on the design of the fuel-injection pump with a single-hole or a two-hole element, the pump cylinder 12 has a control bore 18 (FIG. 2) for the fuel inflow and fuel return or a control bore 18 and an inflow bore 19 (FIG. 1). These bores 18, 19 are connected to a fuel-filled suction space 20 surrounding the pump cylinder 12. The pump piston 11 has on the outside, on its piston casing, an axial longitudinal groove 21 and a control groove 22 which runs obliquely to the pump-piston axis and which on the one hand opens out in the longitudinal groove 21 and on the other hand ends blind in the pump piston 11. The upper edge of the control groove 22 facing the pump working space 13 forms a lower control edge, the so-called spill edge 23, and the edge of the end face 111 of the pump piston 11 forms an upper control edge 24. During the pump-piston stroke, the two control edges 23, 24 cooperate with the control bore 18 in such a way that, during the pump-piston stroke, the start of feed and the end of feed of the fuel-injection pump are determined respectively by the opening and closing of the control bore 18. The start of feed commences when the pump piston 11 has passed with its upper control edge 24 over the control bore 18 and just closes off the control bore 18; the cut-off at the end of feed commences when the spill edge 23 comes into the region of the control bore 18 and the pump working space 13 is thereby connected to the suction space 20 via the longitudinal groove 21 and the control groove 22.

At the start of feed, in the course of the stroke movement of the pump piston 11 the fuel pressure in the pump working space 13 is increased, until the delivery valve 14 opens and fuel flows via the injection delivery conduit 15 to an injection nozzle. At the end of feed, this so-called effective stroke of the pump piston 11 is ended and, during the further stroke of the pump piston 11 to its top dead centre, the fuel is forced back into the suction space 20 via the longitudinal groove 21, the control groove 22 and the control bore 18. After the reversal of movement at top dead centre, the fuel first flows back through the longitudinal groove 21 into the pump working space 13, until the spill edge 23 closes the control bore 18 again. During the further return of the piston, a negative pressure occurs in the pump working space 13, and only after the opening of the inflow bore 19 and of the control bore 18 does the fuel, which is under the pressure of a feed pump in the suction space 20, flow into the pump working space 13. The pump working space 13 is once again filled with fuel.

Figure 4:
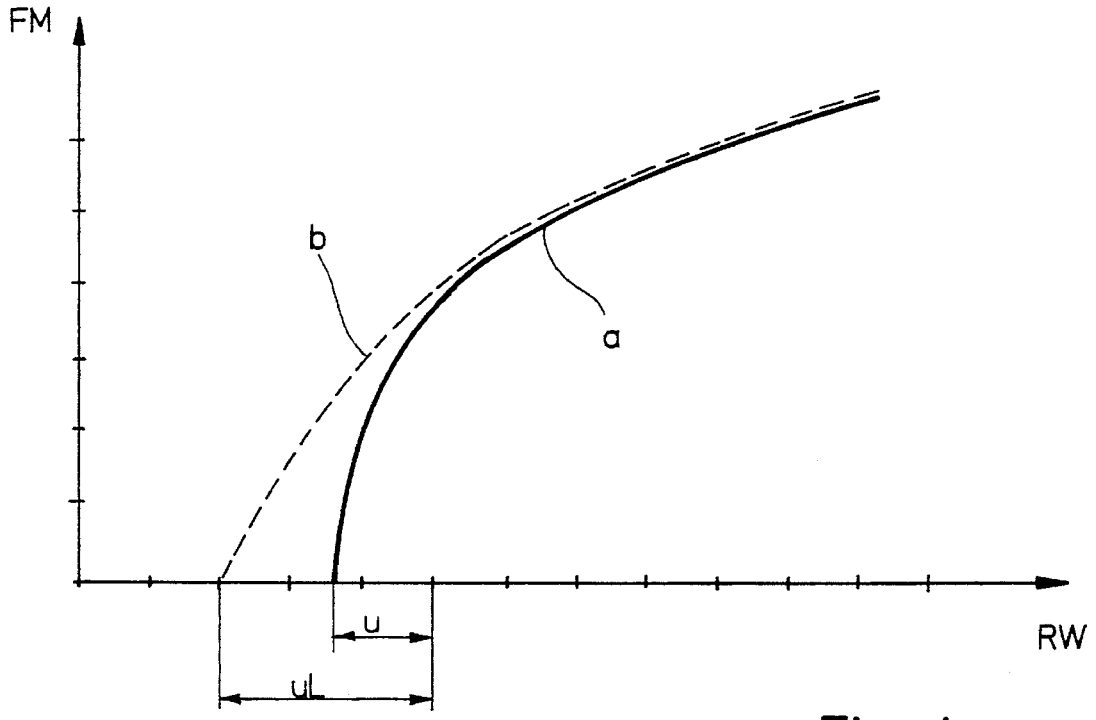

The feed quantity, which is conveyed into the injection delivery conduit 15 during the effective stroke of the pump piston 11, is controlled by means of a feed-quantity regulating device 25, in such a way that the feed quantity is adapted to the load of the internal-combustion engine. This feed-quantity regulating device 25 has a speed regulator, not shown here, which rotates a regulating sleeve 27 via a regulating rod 26. The regulating sleeve 27 transmits its rotational movement to the pump piston 11 via a driver 28, also called a piston lug. The position of the oblique spill edge 23 in the pump piston 11 thereby changes in relation to the control bore 18 in the pump cylinder 12, and the distance which the pump piston 11 covers from the start of feed to the opening of the pump working space 13 by the spill edge 23 likewise changes. This means that, in the piston position for full load, the cut-off is cut off only when the maximum effective stroke of the pump piston 11 has been reached, that is to say after the feed of the largest possible feed quantity. If the pump piston 11 is rotated into the position for part load, the cut-off takes place earlier, depending on the position of the pump piston 11. In the end position for so-called zero feed, the longitudinal bore 21 is located directly in front of the control bore 18, with the result that the pump working space 13 remains connected to the suction space 20 via the pump piston 11 during its entire stroke. No fuel is fed in this position. The feed characteristic of the fuel-injection pump is represented in FIG. 4. There, the trend of the feed quantity FM is represented in dependence on the regulating travel RW, that is to say the rotary travel of the pump piston 11 by the feed-quantity regulating device 25. The unbroken curve a in FIG. 4 shows the feed characteristic for a conventional fuel-injection pump, in which the control groove 22 and its spill edge 23 run at a constant pitch or constant inclination to the pump-piston axis over the pump-piston circumference.

In order to improve the regulating behaviour of the system: fuel-injection pump, internal-combustion engine and feed-quantity regulating device, in the lower load range of the internal-combustion engine, where only small fuel-feed quantities are injected, and to avoid instabilities in the system, here the spill edge 23 in the pump piston 11 is "kinked", that is to say it has two different pitches or two different angles of inclination $\alpha$ to the longitudinal axis 29 of the pump piston 11. This is illustrated by means of FIG. 3 which shows a cutout from a developed view of the pump piston 11. The spill edge 23 runs at a constant angle of inclination $\alpha_1$ to the pump-piston axis 29 in the regulating range for full load and for medium part load. In the regulating range for lower part load, the spill edge 23 is kinked flatly and runs at an angle of inclination $\alpha_2$ to the pump-piston axis 29 which is larger than the angle of inclination $\alpha_1$. The spill edge 23 has a straight run in each of its portions 231 and 232. The curvatures visible in FIG. 3 at the ends of the spill edge 23 are the result of the graphical representation of the developed view. As a result of this "kinking" of the spill edge 23 into a flatter run in the regulating range for lower part load, a feed-quantity characteristic of the fuel-injection pump according to the curve b represented by broken lines in FIG. 4 is achieved. The regulating range for lower load is identified by uL. It can be seen clearly that, as a result of the kinking of the spill edge 23, the feed characteristic b is varied in relation to the feed characteristic a of a conventional fuel-injection pump having a constant run of the spill edge 23, specifically in such a way that, in the constant regulating-travel interval, a substantially smaller flow-off cross-section of the control bore 18 is opened and consequently the feed quantity can be set substantially more effectively via the variation in the regulating travel. This means that, in the lower part-load range of the internal-combustion engine, the injected feed quantity can be substantially more sensitively metered and adapted to the requirement of the internal-combustion engine than is possible with conventional fuel-injection pumps. The position of the kinks between the two spill-edge portions 231 and 232 and their angles of inclination $\alpha_1$ and $\alpha_2$ is dependent on the operating parameters of the internal-combustion engine to be supplied and must be adapted to these, this preferably taking place experimentally. At all events, however, the angle of inclination $\alpha_2$ of the portion 232 in the range of the smallest feed quantities is larger than the angle of inclination $\alpha_1$ of the portion 231 in the range of large and maximum feed quantities, so that the portion 232 runs "flatter" than the portion 231. In principle, it is possible to provide a further kink for the spill edge 23 in the flatter portion 232, in such a way that the end portion of the spill edge 23 opening out in the longitudinal groove 21 acquires an even larger angle of inclination in relation to the pump-piston axis 29, and thus runs even somewhat flatter than the remaining part of the portion 232.

Figure 5:
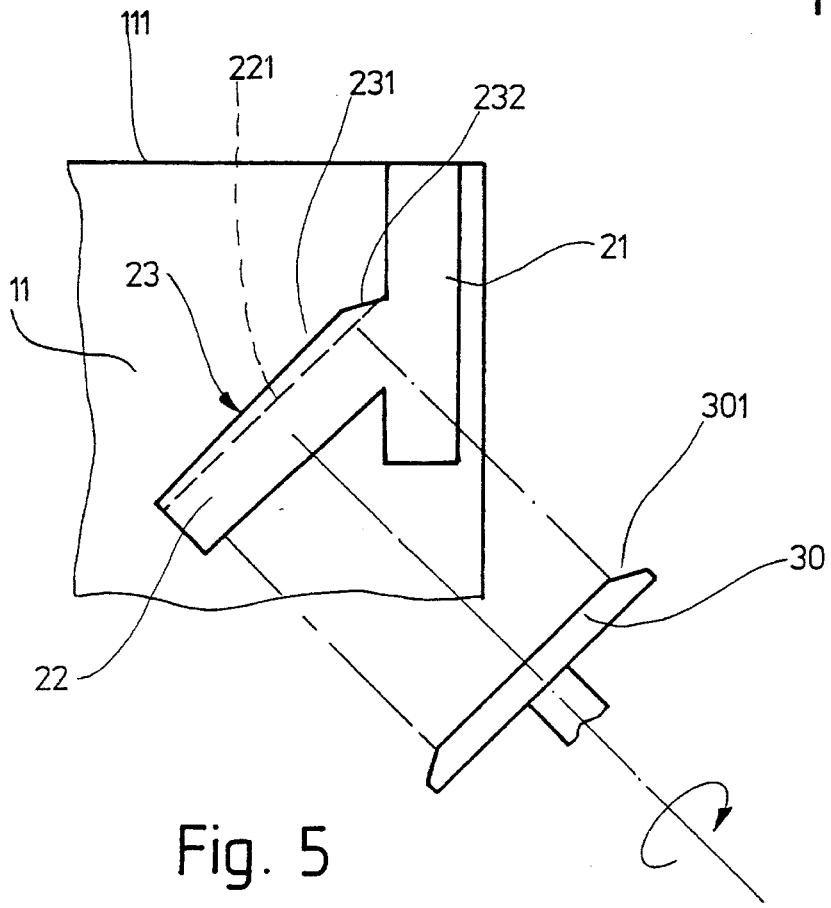
FIG. 5 shows diagrammatically, in cut-out form, a developed view of the pump piston with a grinding head for grinding in the spill edge.

An advantageous production process for making the "kinked" spill edge 23 in the casing of the pump piston 11 is illustrated diagrammatically in FIG. 5. A developed view of the casing of the pump piston 11 with the longitudinal groove 21 and with the control groove 22 is once again to be seen in cut-out form. The longitudinal groove 21 and the control groove 22 are conventionally milled out from the pump piston 11 or plunge-cut into the pump piston 11. Subsequently, in a second process step, the upper groove flank 221 of the control groove 22, the said upper groove flank 221 facing the end face 111, is ground in to form the desired run of the spill edge 23. For this purpose, a specially shaped grinding head 30, the grinding face 301 of which is a negative image of the run of the spill edge 23, is used. By applying the grinding head 30 to the upper groove flank 221 of the control groove 22, with the grinding-head axis oriented at right angles thereto, the spill edge 23 is ground in in the way shown in FIG. 5.

Figure 3:
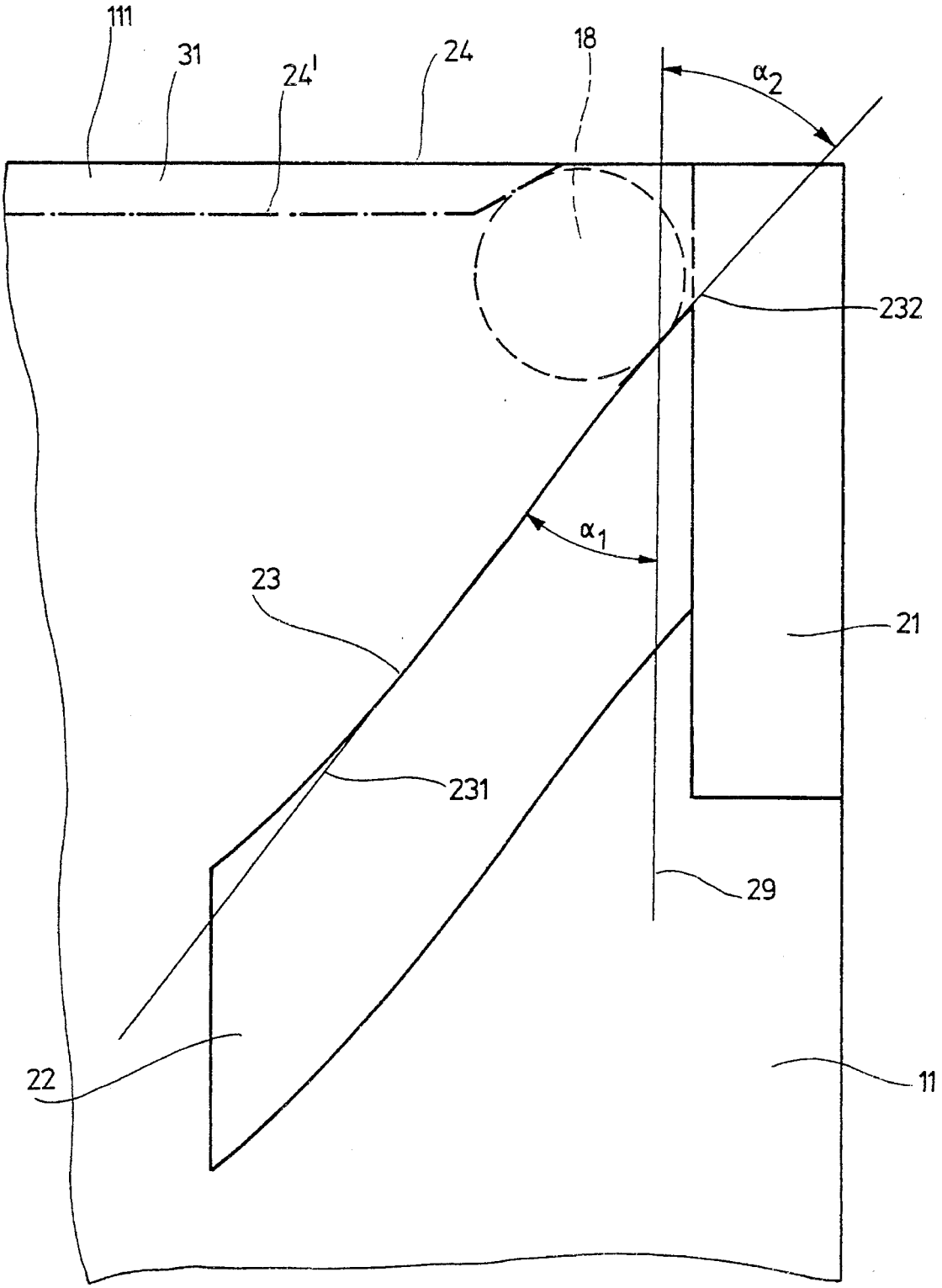
FIG. 3 shows in cut-out form a developed view of the pump-piston casing of the pump element in FIG. 2, FIG. 4 diagram of two feed-quantity characteristics.

In an alternative embodiment of the pump piston 11, as represented by dot-and-dash lines in FIG. 3, the upper control edge 24 is formed, instead of on the end face 111 of the pump piston 11, on the lower groove flank of a groove 31 open towards the end face 111 and running over a part circumference of the pump piston 11. This control edge, which, in FIG. 3, is represented by dot-and-dash lines and is designated by 24', runs in the region of the pump piston 11, which passes over the control bore 18 during the pump-piston stroke in a rotary position assumed by the pump piston 11 in the case of small feed quantities, obliquely towards the edge of the end face of the pump piston 11. As a result of this modification of the upper control edge 24', a control-edge variation is made again, not only at the end of feed, but also at the start of feed, and this control-edge variation is then subtracted in interaction with the spill edge 23 and, in the case of small regulating travels, thus simulates an even "flatter" pitch of the spill edge 23. In this design of the upper control edge 24', at the same time an earlier start of feed than the starter feed under full load or medium part load is achieved, this usually being desirable.

The delivery valve 14 illustrated in FIG. 1 can be designed as a constant-volume relief valve or backflow throttle valve (also called a throttle relief valve). Both valve types are known in terms of design and mode of operation and are described, for example, in MTZ 52 (1991), page 372–379. In so-called valveless fuel-injection pumps, the delivery valve 14 is dispensed with. In these pump types too, the pump element according to the invention, having the "kinked" spill edge 23 in the pump piston 11, can be used with the same advantages.

the foregoing relates to preferred exemplary embodiments of the invention, it being understood that other variants and embodiments thereof are possible within the spirit and scope of the invention, the latter being defined by the appended claims.

We claim:

1. An injection pump for an internal-combustion engine (1), comprising a pump piston (11) which is driven in a to-and-fro axial stroke movement in a pump cylinder (12) and which, by means of an end face (111), limits a pump working space (13) connected to a delivery conduit (14) and cooperates with at least one control bore (18, 19), connected to a fuel-filled suction space (20) and located in the pump cylinder (12), for determining the start of feed and end of feed, in such a way that an upper control edge (24) arranged on the end face (111) of the pump piston (11) determines the start of feed and a lower control edge (23), formed on an outer control groove (22) that extends obliquely over a part of a circumference of the pump piston (11) and constantly connected to the pump working space (13) determines the end of feed, and a feed-quantity regulating device (25) that rotates the pump piston (11) relative to the pump cylinder (12), the lower control edge (23) has, along its run, at least two portions (231, 232) with different angles of inclination ($\alpha_1$, $\alpha_2$) to the axis (29) of the pump piston (11), and in that the control-edge portion (232) with a larger angle of inclination ($\alpha_2$) is provided in the region of the pump piston (11) which passes over the control bore (18) during the pump-piston stroke in a rotary position of the pump piston (11) for small feed quantities that is a lower load range of an internal combustion engine, the upper control edge (24) is formed on a lower groove flank of a groove (31) which is open towards the end face (111) of the pump piston (11) and runs over a part of a circumference of the pump piston (11) and which, in the region of the pump piston (11) which passes over the control bore (18) during the pump-piston stroke in a rotary position assumed by the pump piston (11) in the case of small feed quantities, runs obliquely towards the edge of the end face (111).

2. An injection pump according to claim 1, in which the control groove (22) opens out on one side in an axial longitudinal groove (21) which is located in the pump piston (11) and which passes over the control bore (18) during the pump-piston stroke in a rotary position assumed by the pump piston (11) for a zero feed quantity, and the control-edge portion (232) of the lower control edge (23) having the large angle of inclination ($\alpha_2$) is located directly at the longitudinal groove (21), and the further control-edge portion (231) follows the larger angle of inclination in the order of decreasing angles of inclination.

3. An injection pump according to claim 1, in which the oblique run in the upper control edge (24) is located near the longitudinal groove (21) and ends at a distance from the longitudinal groove (21) in the edge of the end face (111) of the pump piston (11).

4. An injection pump according to claim 2, in which the oblique run in the upper control edge (24) is located near the longitudinal groove (21) and ends at a distance from the longitudinal groove (21) in the edge of the end face (111) of the pump piston (11).

5. An injection pump according to claim 1, in which a delivery valve (14), which is designed as a constant-volume relief valve, is arranged between the pump working space (13) and the injection delivery conduit (15).

6. An injection pump according to claim 2, in which a delivery valve (14), which is designed as a constant-volume relief valve, is arranged between the pump working space (13) and the injection delivery conduit (15).

7. An injection pump according to claim 3, in which a delivery valve (14), which is designed as a constant-volume relief valve, is arranged between the pump working space (13) and the injection delivery conduit (15).

8. An injection pump according to claim 4, in which a delivery valve (14), which is designed as a constant-volume relief valve, is arranged between the pump working space (13) and the injection delivery conduit (15).

* * * * *